US008022801B2

(12) United States Patent
Kondo et al.

(10) Patent No.: US 8,022,801 B2
(45) Date of Patent: Sep. 20, 2011

(54) COIL UNIT AND ELECTRONIC INSTRUMENT

(75) Inventors: Yoichiro Kondo, Chino (JP); Hirofumi Okada, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 722 days.

(21) Appl. No.: 12/071,255

(22) Filed: Feb. 19, 2008

(65) Prior Publication Data

US 2008/0197957 A1 Aug. 21, 2008

(30) Foreign Application Priority Data

Feb. 20, 2007 (JP) ..... 2007-039890
Dec. 20, 2007 (JP) ..... 2007-328245

(51) Int. Cl.
*H01F 5/00* (2006.01)

(52) U.S. Cl. ..... 336/200; 336/223; 336/232

(58) Field of Classification Search ..... 336/200, 336/232, 223
See application file for complete search history.

(56) References Cited

U.S. PATENT DOCUMENTS

| | | | | |
|---|---|---|---|---|
| 3,798,059 | A | 3/1974 | Astle et al. | |
| 5,847,947 | A * | 12/1998 | Pan et al. | 363/61 |
| 6,008,622 | A | 12/1999 | Nakawatase | |
| 6,392,525 | B1 | 5/2002 | Kato et al. | |
| 6,593,841 | B1 * | 7/2003 | Mizoguchi et al. | 336/200 |
| 7,176,423 | B2 | 2/2007 | Kataoka et al. | |
| 2002/0067237 | A1 | 6/2002 | Nakata et al. | |
| 2003/0020583 | A1 * | 1/2003 | Hui et al. | 336/200 |
| 2006/0222821 | A1 | 10/2006 | Masai | |

FOREIGN PATENT DOCUMENTS

| | | | |
|---|---|---|---|
| JP | U-01-156073 | | 10/1989 |
| JP | U-03-090371 | | 9/1991 |
| JP | A 06-303726 | | 10/1994 |
| JP | A 06-311659 | | 11/1994 |
| JP | A 07-322534 | | 12/1995 |
| JP | A-08-148359 | | 6/1996 |
| JP | 08175085 | A * | 7/1996 |
| JP | A-10-097932 | | 4/1998 |
| JP | A-2001-258182 | | 9/2001 |
| JP | A-2003-153457 | | 5/2003 |
| JP | 2003272938 | A * | 9/2003 |
| JP | A-2004-208383 | | 7/2004 |
| JP | A-2004-296981 | | 10/2004 |
| JP | A-2005-260122 | | 9/2005 |
| JP | A-2006-042519 | | 2/2006 |
| JP | A-2006-115592 | | 4/2006 |
| JP | A-2006-339329 | | 12/2006 |

* cited by examiner

*Primary Examiner* — Anh T Mai
(74) *Attorney, Agent, or Firm* — Oliff & Berridge PLC

(57) ABSTRACT

A coil unit includes a planar air-core coil that has an air-core section, a printed circuit board that is disposed on a transmission side of the planar air-core coil, and a magnetic sheet that is disposed on a non-transmission side of the planar air-core coil opposite to the transmission side. The planar air-core coil includes a lead line connected to an inner end of the planar air-core coil over the transmission side, and the printed circuit board includes a receiving section that receives the lead line.

10 Claims, 12 Drawing Sheets

COIL UNIT AND ELECTRONIC INSTRUMENT

Japanese Patent Application No. 2007-39890 filed on Feb. 20, 2007 and Japanese Patent Application No. 2007-328245 filed on Dec. 20, 2007, are hereby incorporated by reference in their entirety.

BACKGROUND OF THE INVENTION

The present invention relates to a coil unit relating to non-contact power transmission using a coil, an electronic instrument, and the like.

Non-contact power transmission which utilizes electromagnetic induction to enable power transmission without metal-to-metal contact has been known. As application examples of non-contact power transmission, charging a portable telephone, a household appliance (e.g., telephone handset), and the like has been proposed.

In power transmission utilizing electromagnetic induction, the amount of deviation of a coil from the coaxial line affects the amount of power transmission to a large extent. Therefore, it is important that a charging target be placed at an appropriate position of a charger. The following technologies have been proposed in order to appropriately position the charging target with respect to the charger.

JP-A-6-311659 discloses technology which prevents insertion of a foreign object between a charging target and a charger so that charging occurs at an appropriate position.

JP-A-7-322534 discloses electromagnetic coupling technology in which a protruding core is inserted into an air-core solenoid coil.

JP-A-6-303726 discloses technology which produces primary/secondary electromagnetic coupling by inserting a primary-side core into an air-core section of a secondary-side coil.

In the above technologies, the core is provided in the coil.

SUMMARY

Aspects of the invention may provide a thin coil unit which enables an increase in power transmission efficiency, an electronic instrument including the same, and the like.

Another aspect of the invention may define an electronic instrument including a housing that receives the above coil unit.

According to one aspect of the invention, there is provided a coil unit comprising:

a planar air-core coil that has an air-core section;

a printed circuit board that is disposed on a transmission side of the planar air-core coil; and a magnetic sheet that is disposed on a non-transmission side of the planar air-core coil, the non-transmission side being opposite to the transmission side, the planar air-core coil including a lead line connected to an inner end of the planar air-core coil over the transmission side; and the printed circuit board including a receiving section that receives the lead line.

According to another aspect of the invention, there is provided a coil unit comprising:

a planar air-core coil that has an air-core section;

a magnetic sheet that is disposed on a non-transmission side of the planar air-core coil opposite to a transmission side; and a printed circuit board that is disposed on a side of the magnetic sheet opposite to a side that is disposed over the planar air-core coil, the planar air-core coil including a lead line connected to an inner end of the planar air-core coil over a side that faces the magnetic sheet; and the printed circuit board including a receiving section that receives the lead line through the magnetic sheet.

According to another aspect of the invention, there is provided a coil unit comprising:

a planar air-core coil that has an air-core section;

a coil-receiving housing that is disposed on a transmission side of the planar air-core coil; and a printed circuit board that is disposed on a non-transmission side of the planar air-core coil, the printed circuit board being fixed on the coil-receiving housing so that the planar air-core coil is placed between the coil-receiving housing and the printed circuit board;

the planar air-core coil including a lead line connected to an inner end of the planar air-core coil over the transmission side; and the coil-receiving housing including a receiving section that receives the lead line.

According to another aspect of the invention, there is provided a coil unit comprising:

a planar air-core coil that has an air-core section;

a printed circuit board that is disposed on a transmission side of the planar air-core coil; and a magnetic sheet that is disposed on a non-transmission side of the planar air-core coil, the planar air-core coil including a lead line connected to an inner end of the planar air-core coil, the lead line being provided on the transmission side; and the printed circuit board including a receiving section that receives the lead line.

According to another aspect of the invention, there is provided a coil unit comprising:

a planar air-core coil that has an air-core section;

a magnetic sheet that is disposed on a non-transmission side of the planar air-core coil, a first side of the magnetic sheet being placed on the planar air-core coil; and a printed circuit board that is disposed on a second side of the magnetic sheet, the planar air-core coil including a lead line that connected to an inner end of the planar air-core coil, the lead line being provided on the non-transmission side; and the printed circuit board including a receiving section that receives the lead line.

According to another aspect of the invention, there is provided a coil unit comprising:

a planar air-core coil that has an air-core section;

a coil-receiving housing that is disposed on a transmission side of the planar air-core coil; and a printed circuit board that is disposed on a non-transmission side of the planar air-core coil, the printed circuit board being fixed on the coil-receiving housing;

the planar air-core coil being placed between the coil-receiving housing and the printed circuit board;

the planar air-core coil including a lead line connected to an inner end of the planar air-core coil on the transmission side; and the coil-receiving housing including a receiving section that receives the lead line.

According to another aspect of the invention, there is provided an electronic instrument comprising one of the above coil units.

DETAILED DESCRIPTION OF THE EMBODIMENT

Figure 1:
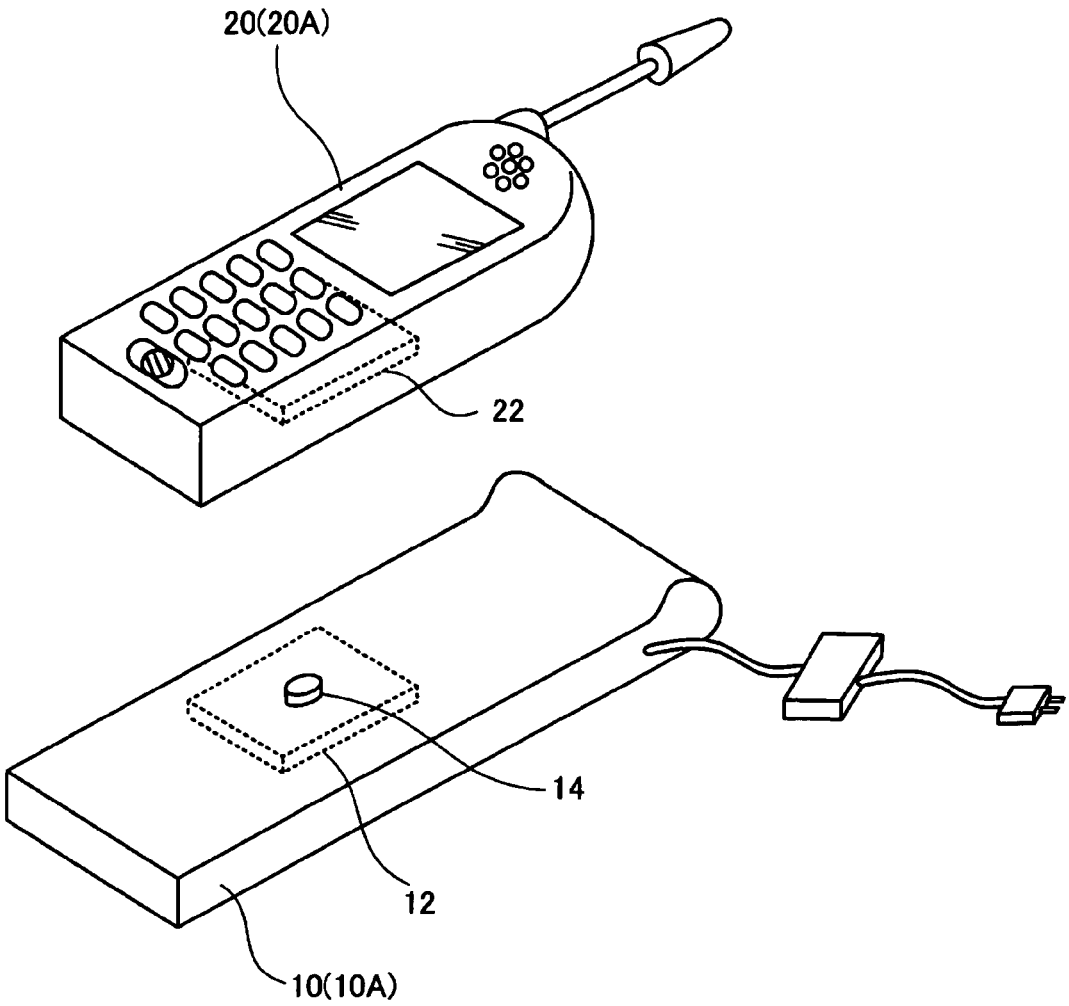
FIG. 1 is a view showing a first embodiment having a charger and a portable telephone horizontally placed on the charger.

According to one embodiment of the invention, there is provided a coil unit comprising:

a planar air-core coil that has an air-core section;

a printed circuit board that is disposed on a transmission side of the planar air-core coil; and a magnetic sheet that is disposed on a non-transmission side of the planar air-core coil, the non-transmission side being opposite to the transmission side, the planar air-core coil including a lead line connected to an inner end of the planar air-core coil over the transmission side; and the printed circuit board including a receiving section that receives the lead line.

The lead line of the inner end of the coil increases the thickness of the planar air-core coil. However, since the lead line is placed in the receiving section of the printed circuit board, a situation in which the entire thickness of the lead line increases the thickness of the coil unit (planar air-core coil+magnetic sheet+printed circuit board) can be prevented, whereby the thickness of the coil unit can be reduced.

In the coil unit, the printed circuit board may include a through-hole that faces an air-core section of the planar air-core coil.

When the through-hole is formed in the printed circuit board, the coil unit can be positioned with respect to a housing which receives the coil unit by inserting a coil positioning protrusion provided on the housing into the air-core section of the planar air-core coil through the through-hole.

In the coil unit, a diameter of the through-hole that is formed in the printed circuit board may be smaller than a diameter of the air-core section of the planar air-core coil; and the coil unit may further include a temperature detection section that is provided on a side of the printed circuit board that is placed over the planar air-core coil, the temperature detection section being provided at a position that is near the through-hole and inside an edge of the air-core section.

The coil unit may further include a temperature detection section that is provided on a side of the printed circuit board opposite to a side that is placed over the planar air-core coil, the temperature detection section being provided at a position on a periphery of the through-hole.

In either case, since a temperature can be detected near the air-core section of the planar air-core coil, the temperature of a foreign object positioned between an electronic instrument and a charger can be appropriately measured. This makes it possible to take measures (e.g., disconnection from power supply) when the temperature has increased to a value equal to or higher than a given value.

According to another embodiment of the invention, there is provided an electronic instrument comprising a housing that receives one of the above coil units. In this case, the housing of the electronic instrument may include a coil positioning protrusion that is formed on an inner surface of the housing, the coil positioning protrusion being inserted into the air-core section of the planar air-core coil through the through-hole that is formed in the printed circuit board to position the planar air-core coil.

According to another embodiment of the invention, there is provided a coil unit comprising:

a planar air-core coil that has an air-core section;

a magnetic sheet that is disposed on a non-transmission side of the planar air-core coil opposite to a transmission side; and a printed circuit board that is disposed on a side of the magnetic sheet opposite to a side that is disposed over the planar air-core coil, the planar air-core coil including a lead line connected to an inner end of the planar air-core coil over a side that faces the magnetic sheet; and the printed circuit board including a receiving section that receives the lead line through the magnetic sheet.

In this case, a situation in which the entire thickness of the lead line increases the thickness of the coil unit (planar air-core coil+magnetic sheet+printed circuit board) can be prevented, whereby the thickness of the coil unit can be reduced.

In an electronic instrument including the above coil unit, since the printed circuit board is not provided between the planar air-core coil and a housing of the electronic instrument, a through-hole need not be formed in the printed circuit board. The coil unit can be positioned with respect to the housing by inserting a coil positioning protrusion provided on the housing of the electronic instrument into the air-core section of the planar air-core coil. Since the planar air-core coil can be disposed in contact with the inner surface of the housing, the distance between the coil units is reduced, whereby transmission efficiency increases.

A coil unit according to another embodiment of the invention may integrally include a coil-receiving housing which forms part of a housing of a charger or an electronic instrument.

According to another embodiment of the invention, there is provided a coil unit comprising:

a planar air-core coil that has an air-core section;

a coil-receiving housing that is disposed on a transmission side of the planar air-core coil; and a printed circuit board that is disposed on a non-transmission side of the planar air-core coil, the printed circuit board being fixed on the coil-receiving housing so that the planar air-core coil is placed between the coil-receiving housing and the printed circuit board;

the planar air-core coil including a lead line connected to an inner end of the planar air-core coil over the transmission side; and the coil-receiving housing including a receiving section that receives the lead line.

According to this configuration, a rigid structure in which the planar air-core coil is placed between the coil-receiving housing and the printed circuit board can be provided before incorporating the coil unit in a housing of an electronic instrument or a charger. This improves the assembling properties of the coil. Moreover, a situation in which the entire thickness of the lead line increases the thickness of the coil unit can be prevented, whereby the thickness of the coil unit can be reduced.

According to this structure, a situation in which the coil is unwound or deformed during transportation or incorporation of the coil can be prevented, whereby deformation of the coil which may adversely affect electrical properties such as inductance can be prevented.

According to this configuration, the coil-receiving housing may include a positioning protrusion that positions the planar air-core coil.

The coil unit may further include a magnetic sheet that is disposed on the non-transmission side of the planar air-core coil. According to this configuration, the planar air-core coil and the magnetic sheet may be placed between the coil-receiving housing and the printed circuit board.

According to another embodiment of the invention, there is provided an electronic instrument comprising the coil unit, an outer surface of the coil-receiving housing may be flush with an outer surface of a housing of the electronic instrument. Specifically, the coil-receiving housing forms part of the housing of the electronic instrument so that the side placed on a charger is made flat.

In the electronic instrument, the housing of the electronic instrument may include a positioning target section that determines a position of a charger. This enables the electronic instrument to be positioned with respect to the charger, whereby transmission efficiency increases.

The above-described structure which absorbs the thickness of the lead line may also be applied to the charger.

According to another embodiment of the invention, there is provided a coil unit comprising:

a planar air-core coil that has an air-core section;

a printed circuit board that is disposed on a transmission side of the planar air-core coil; and a magnetic sheet that is disposed on a non-transmission side of the planar air-core coil, the planar air-core coil including a lead line connected to an inner end of the planar air-core coil, the lead line being provided on the transmission side; and the printed circuit board including a receiving section that receives the lead line.

According to another embodiment of the invention, there is provided a coil unit comprising:

a planar air-core coil that has an air-core section;

a magnetic sheet that is disposed on a non-transmission side of the planar air-core coil, a first side of the magnetic sheet being placed on the planar air-core coil; and a printed circuit board that is disposed on a second side of the magnetic sheet, the planar air-core coil including a lead line connected to an inner end of the planar air-core coil, the lead line being provided on the non-transmission side; and the printed circuit board including a receiving section that receives the lead line.

The coil units according to these embodiments can achieve the same effects as the coil unit according to the above embodiment of the invention.

According to another embodiment of the invention, there is provided a coil unit comprising:

a planar air-core coil that has an air-core section;

a coil-receiving housing that is disposed on a transmission side of the planar air-core coil; and a printed circuit board that is disposed on a non-transmission side of the planar air-core coil, the printed circuit board being fixed on the coil-receiving housing;

the planar air-core coil being placed between the coil-receiving housing and the printed circuit board;

the planar air-core coil including a lead line connected to an inner end of the planar air-core coil on the transmission side; and the coil-receiving housing including a receiving section that receives the lead line.

The coil unit according to this embodiment can achieve the same effects as the coil unit according to the embodiment of the invention in which the receiving section is formed in the coil-receiving housing.

According to another embodiment of the invention, there is provided an electronic instrument comprising one of the above coil units.

Preferred embodiments of the invention are described in detail below. Note that the embodiments described below do not in any way limit the scope of the invention defined by the claims laid out herein. Note that all elements of the embodiments described below should not necessarily be taken as essential requirements for the invention.

1. Charging System

Figure 2:
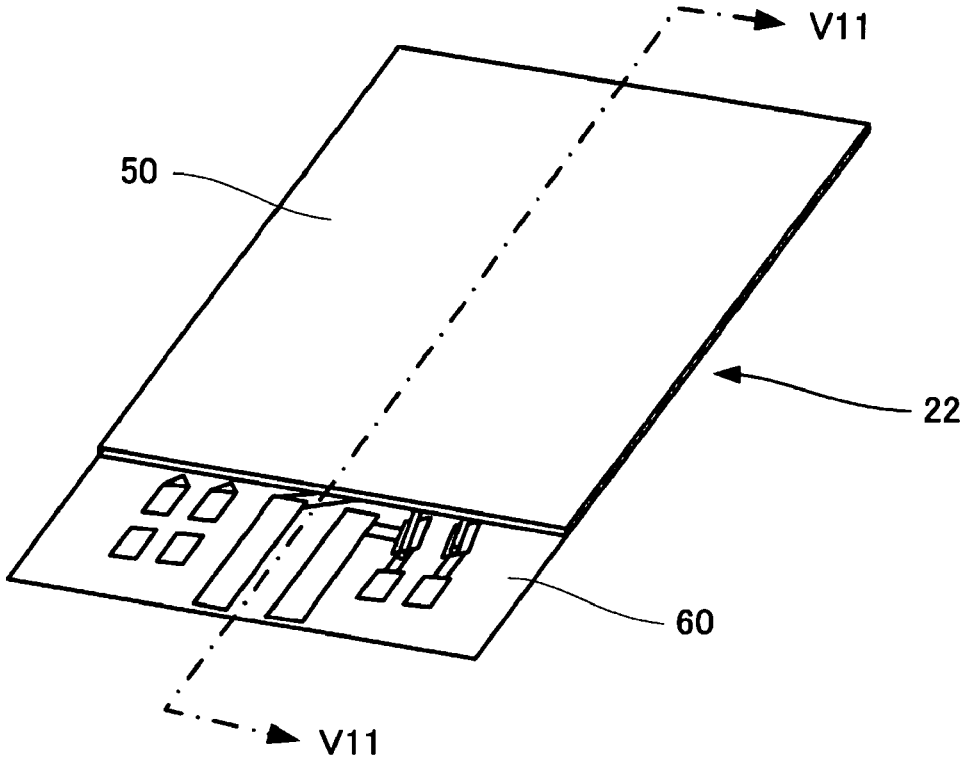
FIG. 2 is an oblique view showing a coil unit.

FIGS. 1 and 2 are views schematically showing a charging system including a charger 10 and an electronic instrument (e.g., portable telephone 20) which is charged using the charger 10. FIG. 1 shows a portable telephone 20A which is horizontally placed on a charger 10A. The portable telephone 20A is charged using the charger 10A by non-contact power transmission utilizing electromagnetic induction which occurs between a coil of a coil unit 12 of the charger 10A and a coil of a coil unit 22 of the portable telephone 20A.

The portable telephone 20A is placed on the charger 10A in a state in which a positioning depression (positioning target section in a broad sense) (not shown in FIG. 1) is positioned with respect to a positioning protrusion 14 (positioning section in a broad sense) of the charger 10A. Since the portable telephone 20A is placed on the charger 10A while positioning the positioning depression with respect to the positioning protrusion 14, the portable telephone 20A can be placed on the charger 10A at an appropriate position, whereby transmission efficiency can be increased.

The opposite sides of the coil units 12 and 22 through which the coil units 12 and 22 perform non-contact power transmission as shown in FIG. 1 are referred to as transmission sides. In FIG. 1, the upper side of the coil unit 12 is the transmission side, and the lower side of the coil unit 22 is the transmission side. The side opposite to the transmission side is referred to as a non-transmission side.

2. Structure of Coil Unit 2.1 Coil Unit in which Coil Inner End Lead Line is Provided Over Transmission Side The coil units 12 and 22 are described in detail below taking the thin coil unit 22 suitable for the portable telephone 20 as an example.

Figure 3A:
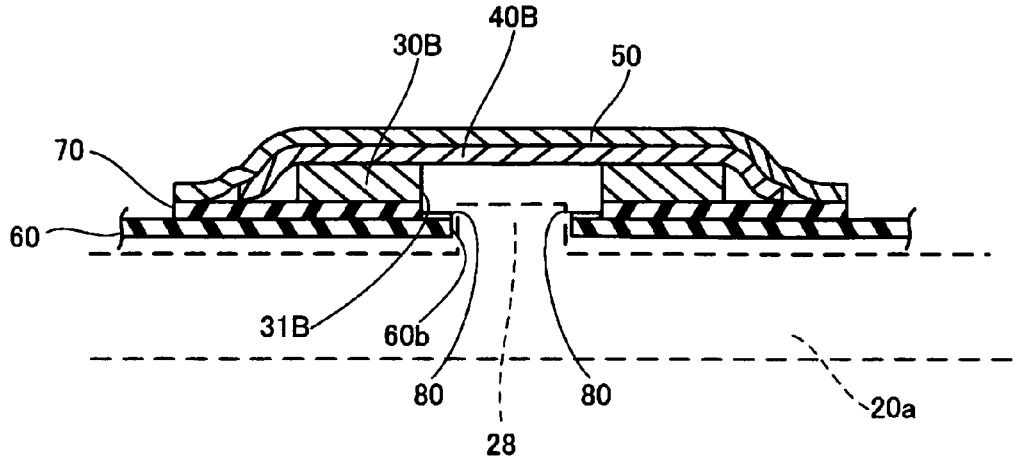
FIGS. 3A and 3B are cross-sectional views schematically showing a cross section of a coil unit along a line VII-VII shown in FIG. 2.
Figure 3B:
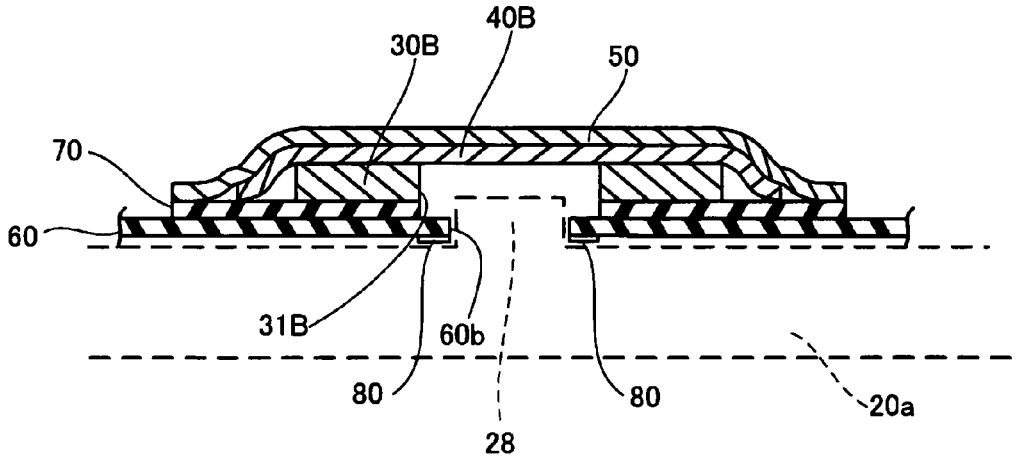
Figure 4:
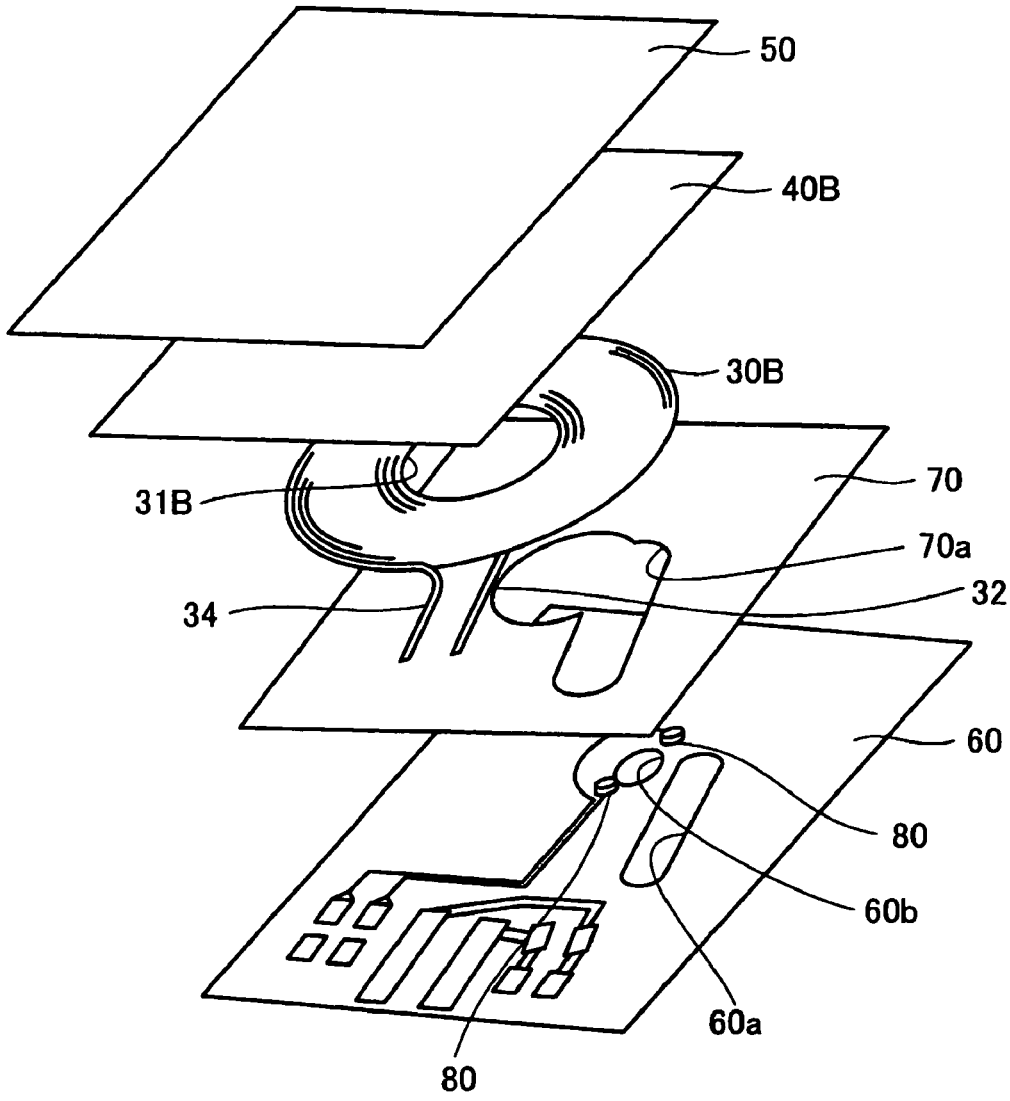
FIG. 4 is an exploded oblique view showing a coil unit.
Figure 5:
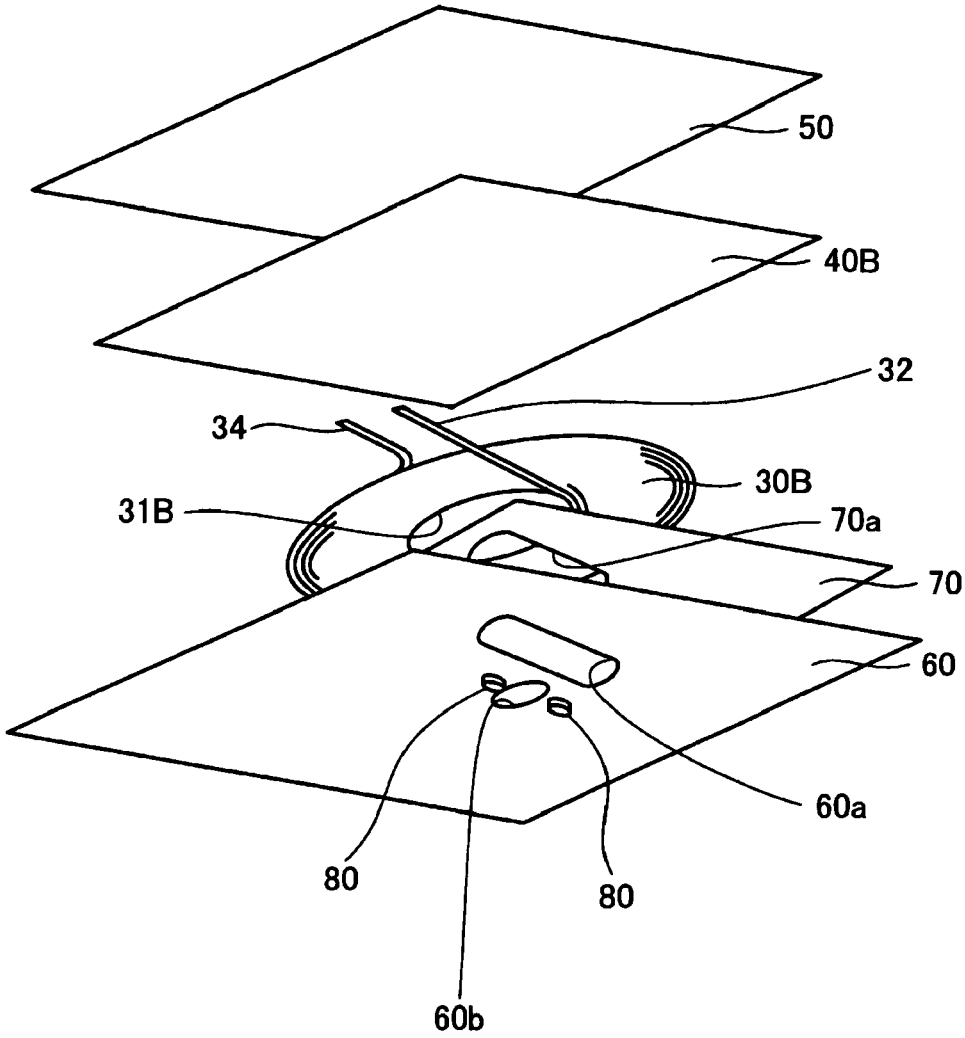
FIG. 5 is an exploded oblique view showing another example of a coil unit.

FIG. 2 is an oblique view showing the coil unit 22. FIGS. 3A and 3B are cross-sectional views schematically showing two types of coil units 22 along the line VII-VII shown in FIG. 2. FIGS. 4 and 5 are exploded oblique views showing the coil units 22 shown in FIGS. 3A and 3B.

The coil unit 22 includes a planar air-core coil 30B, a magnetic sheet 40B, and a magnetic flux leakage prevention member 50 provided in that order on the side of a printed circuit board (e.g., flexible circuit board) 60 opposite to the side which faces a housing 20*a* through a double-sided tape 70.

Figure 6:
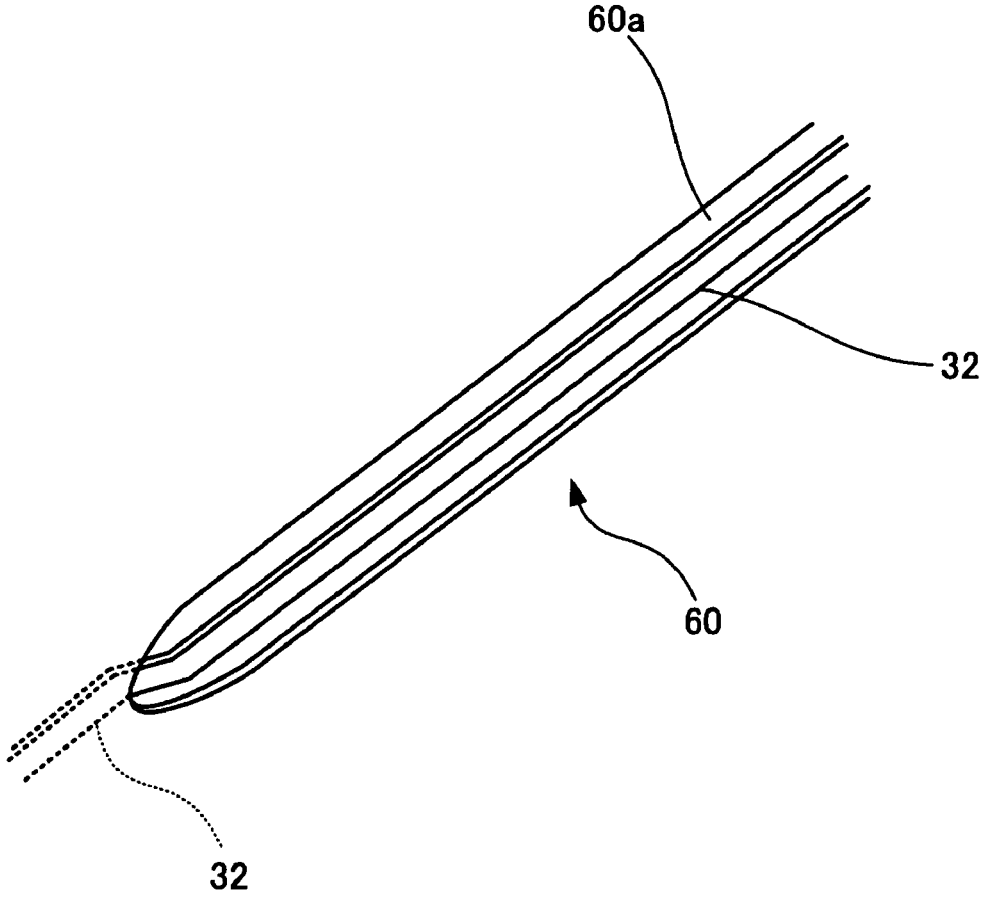
FIG. 6 is a view showing the relationship between a receiving section of a printed circuit board and a lead line.

As shown in FIGS. 4 and 5, the planar air-core coil 30B has a lead line 32 which connects or withdraws the inner end of the planar air-core coil 30B over the transmission side. A lead line 34 connects or withdraws the outer end of the planar air-core coil 30B. Placement sections 60*a* and 70*a* which receive the lead line 32 are respectively formed (cut) in the double-sided tape 70 and the printed circuit board 60 disposed on the side of the coil on which the lead line 32 is provided. The receiving sections 60*a* and 70*a* are formed of long holes, for example. As shown in FIG. 6, the lead line 32 is placed in the receiving section 60*a* when viewed from the printed circuit board 60. The lead line 32 does not increase the thickness of the coil unit 22 or the degree to which the lead line 32 increases the thickness of the coil unit 22 can be reduced by placing the lead line 32 in the receiving sections 60*a* and 70*a*.

As shown in FIGS. 4 and 5, a through-hole 60*b* is formed in the printed circuit board 60 at a position corresponding to an air-core section 31B of the planar air-core coil 30B. The diameter of the through-hole 60*b* is set to be smaller than the diameter of the air-core section 31B of the planar air-core coil 30B. A temperature detection section 80 (e.g., thermistor) is provided on the side of the printed circuit board 60 which faces the planar air-core coil 30B (example shown in FIGS. 3A and 4) or the side of the printed circuit board 60 opposite to the side which faces the planar air-core coil 30B (example shown in FIGS. 3B and 5) inside the air-core section 31B. The temperature of a foreign object which enters the space between the charger 10 and the portable telephone 20 can be detected by providing the temperature detection section 80 inside the air-core section 31B. In particular, a foreign object which is positioned near the air-core section 31B having a high magnetic flux density produces a considerable amount of heat due to eddy current. The temperature of the foreign object can be accurately detected by providing the temperature detection section 80.

The side surface of the magnetic sheet 40B may be covered with the magnetic flux leakage prevention member 50, as shown in FIGS. 3A and 3B. This prevents corrosion of the magnetic sheet 40B or scattering of a magnetic powder due to breakage of the magnetic sheet or the like.

The magnetic sheet 40B of the portable telephone 20 may be formed to be larger than the external shape of a planar air-core coil 30A of the charger 10. This prevents a situation in which a chargeable battery provided in the coil unit 22 or a metal of the circuit board undergoes eddy current loss, whereby power transmission efficiency can be increased.

Figure 7:
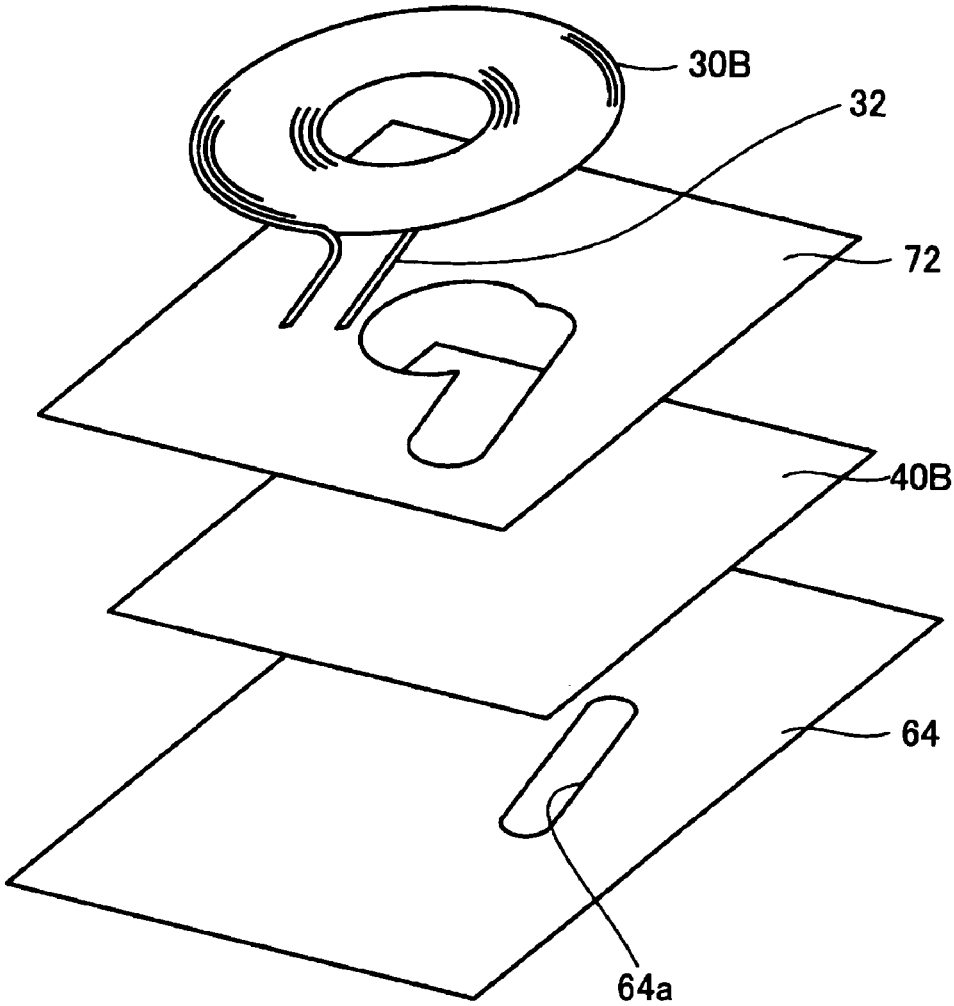
FIG. 7 is an exploded oblique view showing a further example of a coil unit.

2.2 Coil Unit in which Coil Inner End Lead Line is Provided Over Non-Transmission Side FIG. 7 is an exploded oblique view showing a second configuration example. This configuration example illustrates the case of providing the lead line 32 of the inner end of the planar air-core coil 30 on the non-transmission side opposite to the transmission side (housing side).

As shown in FIG. 7, the magnetic sheet 40B is provided on the non-transmission side (lower side in FIG. 7) of the planar air-core coil 30B opposite to the transmission side through a double-sided tape 72. A printed circuit board 64 is provided under the magnetic sheet 40B. Specifically, when the side of the magnetic sheet 40B which comes into contact with the planar air-core coil 30B is referred to as a first side, the printed circuit board 64 comes into contact with a second side of the magnetic sheet 40B. A receiving section (through-hole or depression) 64*a* is formed in the printed circuit board 64 at a position corresponding to the lead line 32. The thickness of the lead line 32 can be absorbed by the receiving section 64*a* through deformation of the magnetic sheet 40B by forming the receiving section 64*a*.

According to the structure shown in FIG. 7, since the planar air-core coil 30 is disposed so that the transmission side of the planar air-core coil 30 faces the inner surface of the housing of the portable telephone 20, the distance between the primary coil unit 12 and the secondary coil unit 22 is reduced as compared with the above example so that transmission efficiency may be increased. Moreover, the planar air-core coil 30 can be positioned with respect to the housing by placing a positioning protrusion which protrudes from the inner surface of the housing of the portable telephone 20 in the air-core section of the planar air-core coil 30. In this case, it is unnecessary to form a positioning through-hole in the printed circuit board 64.

2.3 Coil Unit having Coil-Receiving Housing

Figure 8:
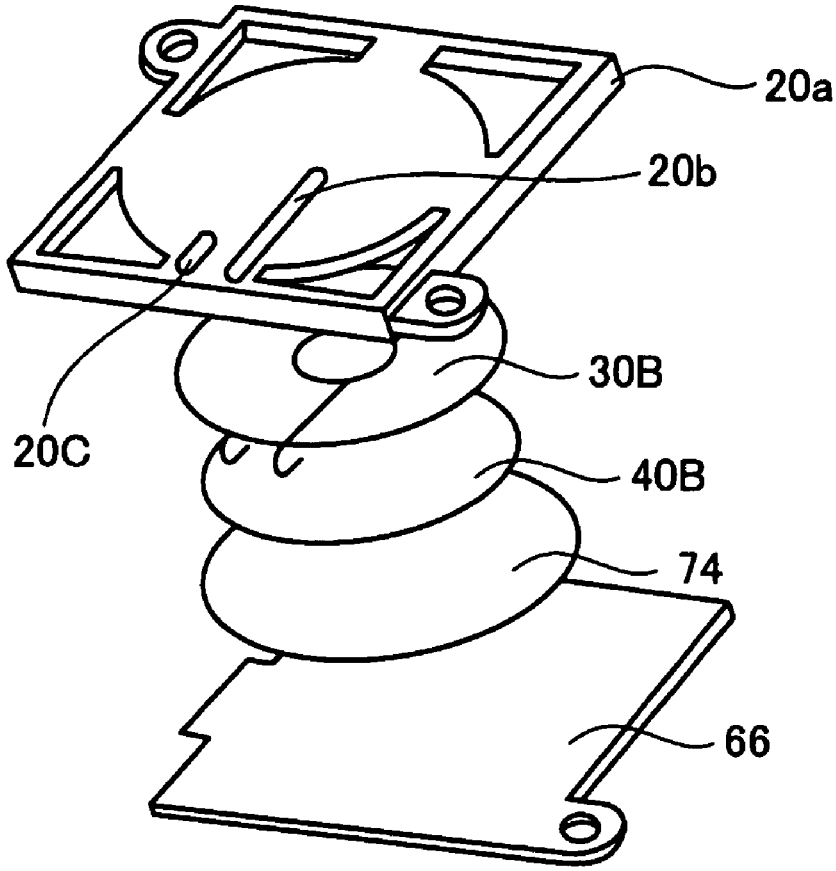
FIG. 8 is an exploded oblique view showing a coil unit having a coil-receiving housing.
Figure 9:
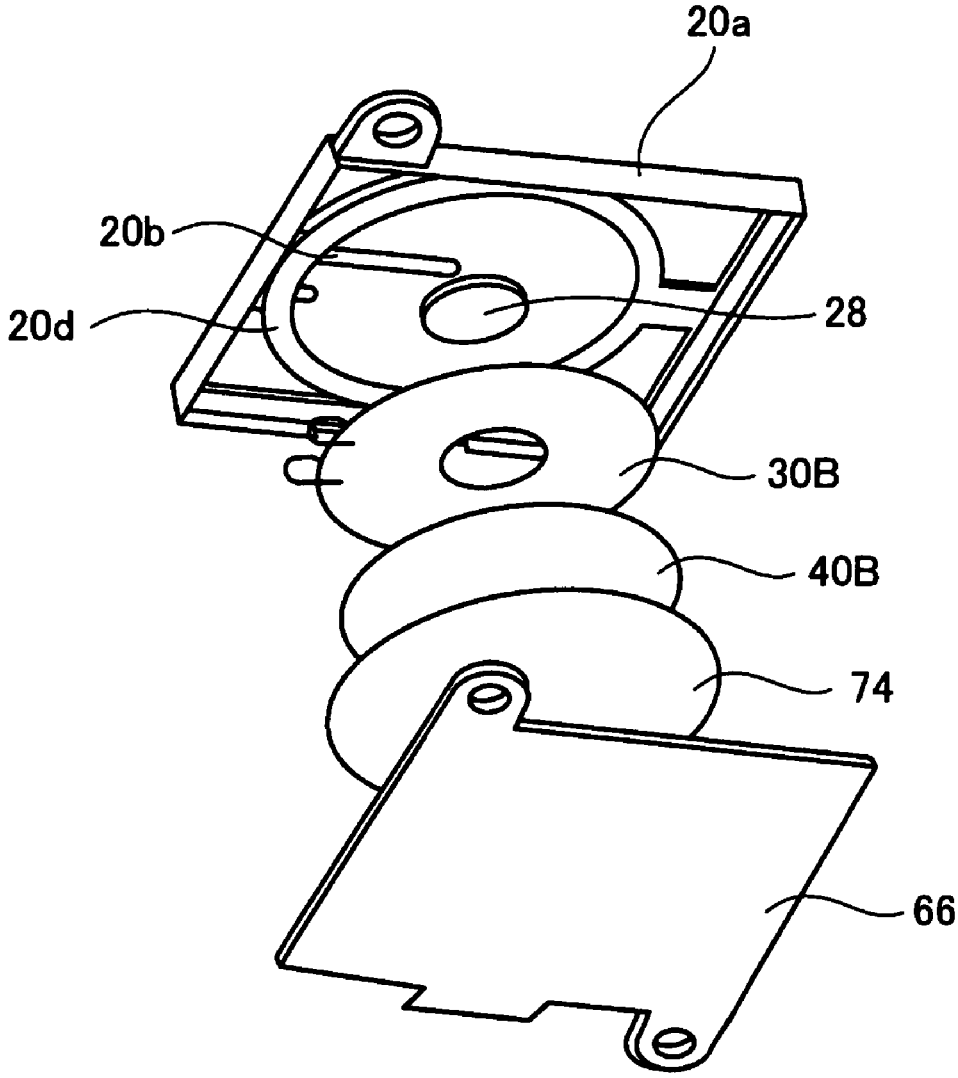
FIG. 9 is an exploded oblique view showing the coil unit shown in FIG. 8 at a different angle.

FIGS. 8 and 9 are exploded oblique views showing a coil unit which includes part of the housing 20*a* of the portable telephone 20 shown in FIG. 1 as a coil-receiving housing at different angles. The coil-receiving housing forms part of the external housing of the charger 10 or the electronic instrument 20. The outer surface of the external housing is flush with the outer surface of the coil-receiving housing. This configuration example shown in FIGS. 8 and 9 illustrates the case of providing the lead line 32 of the inner end of the planar air-core coil 30 on the transmission side (housing side). Note that the lead line 32 of the inner end of the planar air-core coil 30 may be provided on the non-transmission side (magnetic sheet side).

As shown in FIGS. 8 and 9, the planar air-core coil 30B, the magnetic sheet 40B, and a one-sided tape 74 are provided between the coil-receiving housing 20*a* and a printed circuit board 66. In this embodiment, the magnetic sheet 40*b* is not an indispensable element. The coil-receiving housing 20*a* has a receiving section 20*b* which receives the lead line 32 of the inner end of the planar air-core coil 30B, and a receiving section 20*c* which receives the lead line 34 of the outer end of the planar air-core coil 30B. The lead line 32 of the inner end of the coil is pulled out to the side opposite to the transmission side and is connected to the printed circuit board 66.

Figure 10:
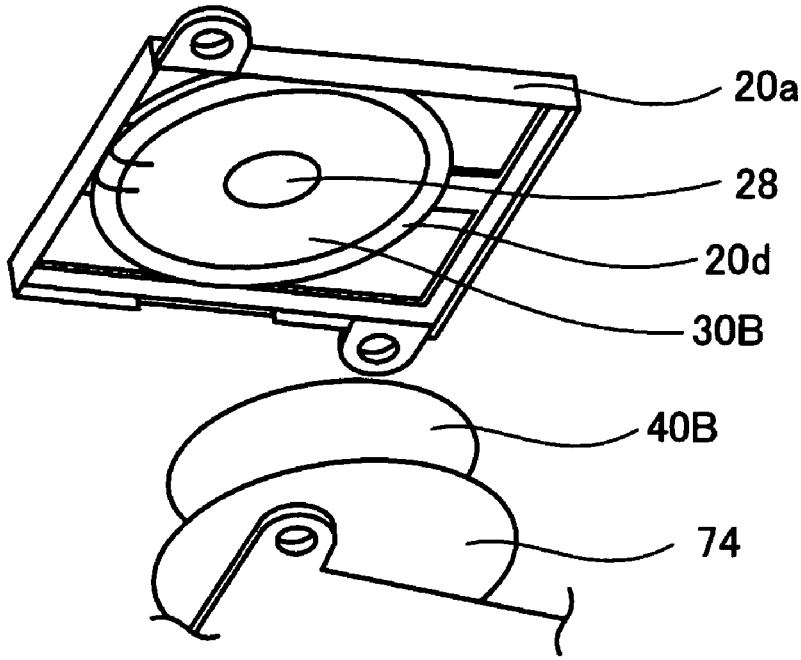
FIG. 10 is a view schematically showing a first manufacturing step of the coil unit shown in FIG. 8.
Figure 11:
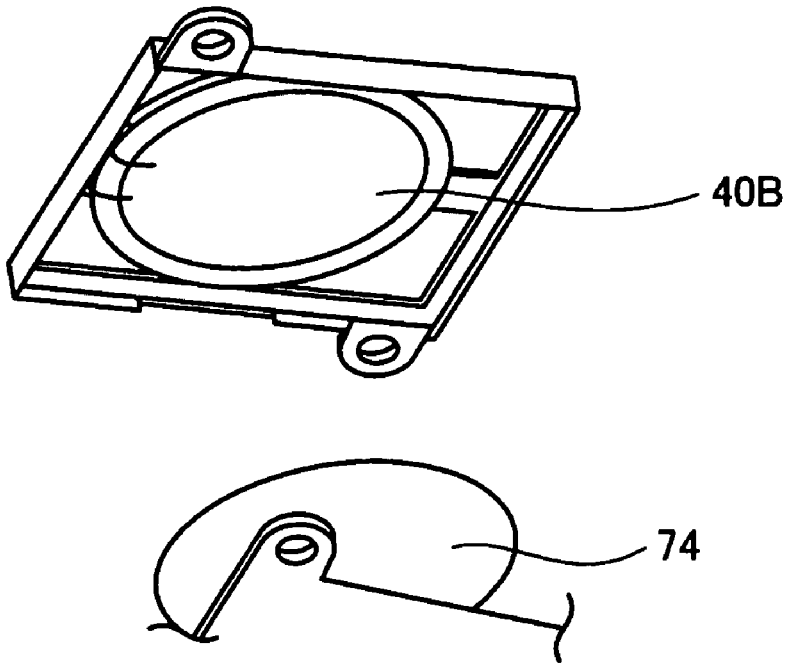
FIG. 11 is a view schematically showing a second manufacturing step of the coil unit shown in FIG. 8.
Figure 12:
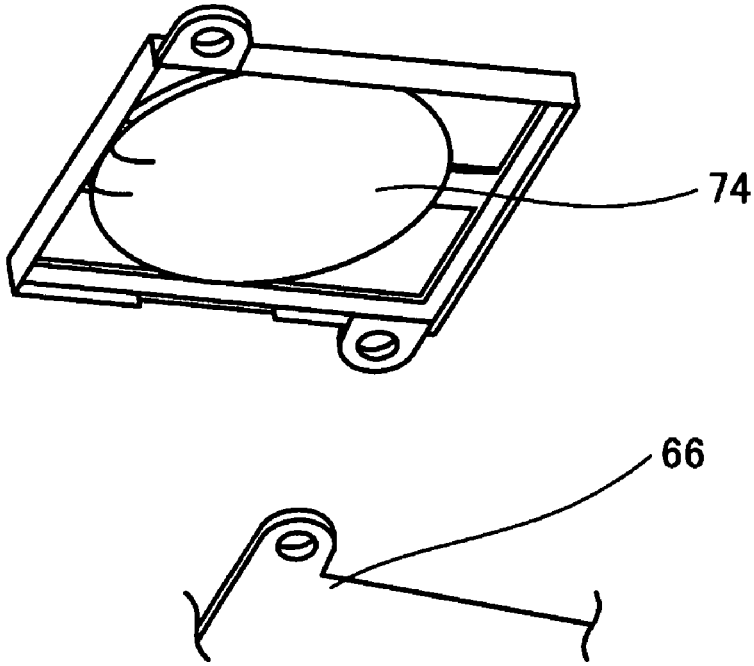
FIG. 12 is a view schematically showing a third manufacturing step of the coil unit shown in FIG. 8.
Figure 13:
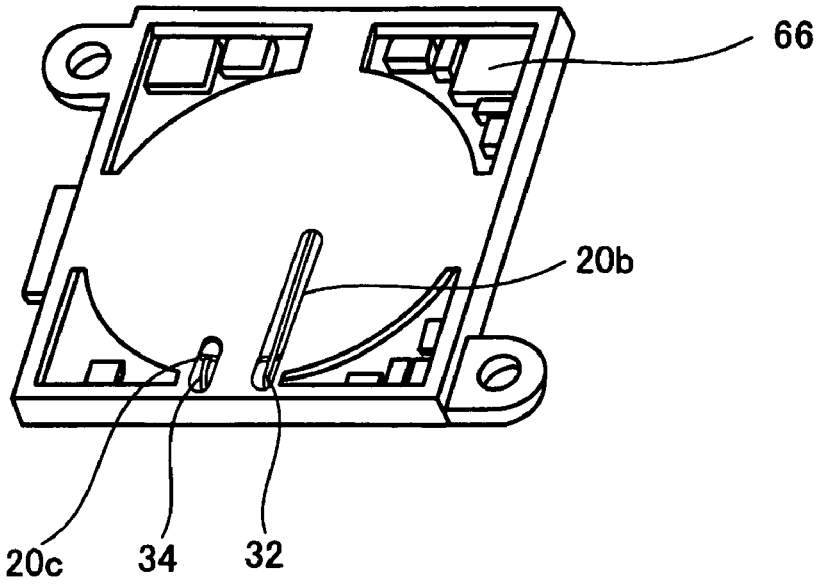
FIG. 13 is a view schematically showing a fourth manufacturing step of the coil unit shown in FIG. 8.

FIGS. 10 to 13 are views schematically showing a process of manufacturing the coil unit. As shown in FIG. 10, the planar air-core coil 30B is placed inside a ring-shaped rib 20*d* of the coil-receiving housing 20*a*. The planar air-core coil 30B is positioned utilizing a positioning protrusion 28 provided on the coil-receiving housing 20*a*. As shown in FIG. 11, the magnetic sheet 40B is attached to the planar air-core coil 30B so that the magnetic sheet 40B is positioned over the planar air-core coil 30B. As shown in FIG. 12, the magnetic sheet 40B is covered with the one-sided tape 74 so that a soft magnetic metal powder does not fall onto the printed circuit board provided under the magnetic sheet 40B from the outer edge of the magnetic sheet 40B. As shown in FIG. 13, the printed circuit board 66 is attached. The receiving sections 20*b* and 20*c* formed in the housing 20*a* are sealed with an adhesive or a molding material in order to prevent the material (soft magnetic metal powder) for the magnetic sheet from leaking through the receiving sections 20*b* and 20*c*.

According to this structure, a situation in which the coil is unwound or deformed during transportation or incorporation of the coil can be prevented as compared with the coil unit shown in FIGS. 2 to 7, whereby deformation of the coil which may adversely affect electrical properties such as inductance can be prevented.

The structures shown in FIGS. 2 to 13 may also be applied to the coil unit 12 of the charger 10.

Application Example of Electronic Instrument

The above embodiments may be applied to an electronic instrument which performs power transmission or signal transmission. For example, the above embodiments may be applied to a charging target including a secondary battery (e.g., wristwatch, electric toothbrush, electric shaver, cordless telephone, personal handyphone, mobile personal computer, personal digital assistant (PDA), or power-assisted bicycle) and a charger.

Although only some embodiments of the invention have been described in detail above, those skilled in the art would readily appreciate that many modifications are possible in the embodiments without materially departing from the novel teachings and advantages of the invention. Accordingly, such modifications are intended to be included within the scope of the invention. Any term cited with a different term having a broader meaning or the same meaning at least once in the specification and the drawings can be replaced by the different term in any place in the specification and the drawings.

The above embodiments have been described taking an example relating to non-contact power transmission. Note that the invention may be similarly applied to non-contact signal transmission utilizing an electromagnetic induction principle.

Although only some embodiments of the invention have been described in detail above, those skilled in the art would readily appreciate that many modifications are possible in the embodiments without materially departing from the novel teachings and advantages of the invention. Accordingly, such modifications are intended to be included within the scope of the invention.

What is claimed is:

1. A coil unit comprising:

a planar air-core coil that has an air-core section;

a printed circuit board that is disposed on a transmission side of the planar air-core coil; and a magnetic sheet that is disposed on a non-transmission side of the planar air-core coil, the non-transmission side being opposite to the transmission side, the planar air-core coil including a lead line connected to an inner end of the planar air-core coil over the transmission side; and the printed circuit board including a receiving section that houses the line so that an increase in a thickness of the coil unit due to the lead line is reduced.

2. The coil unit as defined in claim 1, the printed circuit board including a through-hole that faces an air-core section of the planar air-core coil.

3. The coil unit as defined in claim 2, a diameter of the through-hole that is formed in the printed circuit board being smaller than a diameter of the air-core section of the planar air-core coil; and the coil unit further including a temperature detection section that is provided on a side of the printed circuit board that is placed over the planar air-core coil, the temperature detection section being provided at a position that is near the through-hole and inside an edge of the air-core section.

4. The coil unit as defined in claim 1, the coil unit further including a temperature detection section that is provided on a side of the printed circuit board opposite to a side that is placed over the planar air-core coil, the temperature detection section being provided at a position on a periphery of the through-hole.

5. An electronic instrument comprising a housing that receives the coil unit as defined in claim 1, the housing of the electronic instrument including a coil positioning protrusion that is formed on an inner surface of the housing, the coil positioning protrusion being inserted into the air-core section of the planar air-core coil through the through-hole that is formed in the printed circuit board to position the planar air-core coil.

6. The electronic instrument as defined in claim 5, the housing of the electronic instrument including a positioning target section that determines a position of a charger.

7. The coil unit according to claim 1, the receiving section is defined as an opening in the printed circuit board, and the lead line is housed along a perimeter of the receiving section.

8. A coil unit comprising:

a planar air-core coil that has an air-core section;

a magnetic sheet that is disposed on a non-transmission side of the planar air-core coil, a first side of the magnetic sheet being placed on the planar air-core coil; and a printed circuit board that is disposed on a second side of the magnetic sheet, the planar air-core coil including a lead line connected to an inner end of the planar air-core coil, the lead line being provided on the non-transmission side; and the printed circuit board including a receiving section that houses the lead line so that an increase in a thickness of the coil unit due to the lead line is reduced.

9. A coil unit comprising:

a planar air-core coil that has an air-core section;

a printed circuit board that is disposed on a transmission side of the planar air-core coil; and a magnetic sheet that is disposed on a non-transmission side of the planar air-core coil, the planar air-core coil including a lead line connected to an inner end of the planar air-core coil, the lead line being provided on the transmission side; and the printed circuit board including a receiving section that houses the lead line so that an increase in a thickness of the coil unit due to the lead line is reduced.

10. An electronic instrument comprising the coil unit as defined in claim 9.

* * * * *